US005599133A

United States Patent [19]

Costello et al.

[11] Patent Number: 5,599,133

[45] Date of Patent: Feb. 4, 1997

[54] METHOD AND APPARATUS FOR PAINTING ROAD SURFACES

[75] Inventors: Bernard J. Costello, Princeton, N.J.; Brendan F. Hogan, Yardley, Pa.

[73] Assignee: Argus International, Ringoes, N.J.

[21] Appl. No.: 450,700

[22] Filed: May 25, 1995

[51] Int. Cl.[6] ..... E01C 3/06

[52] U.S. Cl. ..... 404/72; 404/93; 404/95; 432/227; 432/230

[58] Field of Search ..... 404/72, 77, 79, 404/93–95; 118/305, 630; 432/227, 229, 230

[56] References Cited

U.S. PATENT DOCUMENTS

| | | | |
|---|---|---|---|
| 3,472,200 | 10/1969 | Gerling | 118/665 |
| 4,378,207 | 3/1983 | Smith | 432/8 |
| 4,443,185 | 4/1984 | Smith | 432/59 |
| 4,474,552 | 10/1984 | Smith | 431/328 |
| 4,604,054 | 8/1986 | Smith | 431/328 |
| 4,765,773 | 8/1988 | Hopkins | 404/94 |
| 5,090,898 | 2/1992 | Smith | 431/326 |
| 5,174,751 | 12/1992 | Chapman et al. | 432/227 |

*Primary Examiner*—Henry A. Bennett
*Assistant Examiner*—Pamela A. O'Connor
*Attorney, Agent, or Firm*—Louis Weinstein

[57] ABSTRACT

A method and apparatus for painting highway stripes and other patterns on a road surface includes the steps of heating the road surface to be painted or treated with a protective coating to a temperature typically in the range of 150° F. to 165° F. Paint is applied in spray form, the resin and hardener ingredients being mixed preparatory to spraying by a spray head. The paint mixture is sprayed onto the heated road surface as soon after the heat treatment as is practical. The paint spray may be heated as it passes through the nozzle. Granulated glass beads may be dropped onto the paint coating to enhance absorption of heat energy by the paint. The spraying operation is followed as soon as practical by a post-heating operation which preferably achieves temperatures in the aforesaid range, the pre- and post-heating operations significantly enhancing the cross-linking and drying of the paint or other coating enabling substantially immediate use of the road surface by vehicular and/or pedestrian traffic. The energy levels and the heating units and their spacing from the road surface are adjusted to heat the road surface (and paint) to the desired temperature.

13 Claims, 2 Drawing Sheets

METHOD AND APPARATUS FOR PAINTING ROAD SURFACES

FIELD OF THE INVENTION

The present invention relates to painting of road surfaces and the like and more particularly to the utilization of pre- and/or post-heating of the road surface being painted to enhance cross-linking and drying of the paint ingredients and thereby significantly reduce the overall costs normally encountered in conventional painting operations.

BACKGROUND OF THE INVENTION

Road surfaces such as concrete, asphalt, macadam surfaces and the like utilized for interstate, major and even rural roadways are customarily provided with painted stripes and other patterns and indicia which serve as lane indicators, roadway edges, pedestrian crosswalk indicators and the like.

These patterns, stripes and the like, in addition to being initially provided on road surfaces, must also be replaced from time to time due to their constant wearing by both vehicular and pedestrian traffic as well as erosion caused by natural elements (i.e. wind, rain, snow, constant temperature changes, etc.).

The conventional method for providing such road surface markings includes setting down temporary, typically portable traffic detouring devices arranged at spaced distances along a road surface and in such a manner as to indicate to vehicular traffic that a road surface or portions thereof are temporarily closed and that traffic is being detoured therearound to permit the painting operation to be performed safely and without interference with vehicular traffic. Although painting operations may be scheduled during periods of low traffic volume, traffic congestion can hardly be avoided.

Once the highway detour markers (i.e. cones) are in place, markings are provided to identify the stripe or other pattern to be painted onto the road surface. This operation is typically performed by a vehicle having apparatus thereon for placing the markings on the road surface, which markings act as guides for the painting operation which follows the laying down of the guide markings. The vehicles employed for the laying down of the guide markings and the paint operation are typically separate vehicles.

The painting operation is preferably performed utilizing mechanized apparatus arranged upon a vehicle, which is fitted with equipment capable of detecting the guide markers and positioning the spray equipment to follow the guide markers and thereby accurately place the spray pattern at the desired location upon the road surface.

The paint is typically allowed to dry for before the roadway is reopened to vehicular traffic in order to prevent the painted markings from being lifted onto the tires of vehicles and thereby be "reprinted" upon the road surface thus deteriorating and significantly reducing the effectiveness and the useful life of the painted markings. The paints presently developed for use in painting road surfaces and having superior wear properties require longer drying times, typically 25 to 30 minutes and are thus more expensive to use and apply.

The conventional techniques utilized for reducing drying time include limiting performance of the painting operation to the summer months or at the minimum, and typically to clear, dry days at those times of the year during which warmer temperatures are encountered. In addition, the paint ingredients may be heated as they are mixed preparatory to being sprayed, which technique somewhat promotes cross-linkage and drying of the paint ingredients.

Nevertheless, even when the above techniques are employed the paint requires at least 20–30 minutes to dry.

The cones placed on the road surface are removed from the road surface after the paint has dried, enabling the roadway to be returned to normal usage.

The conventional methods described above are very highly labor intensive adding significantly to the cost of the operation. The time required to perform all of the steps involved in the painting operation results in a significant contribution to the amount of inconvenience and congestion experienced by vehicular and/or pedestrian traffic over the period of time during which the roadway or portions thereof are closed to such traffic which further contributes to the need for improved and effective painting techniques in order to reduce traffic congestion as well as costs.

BRIEF DESCRIPTION OF THE INVENTION

The present invention is characterized by comprising method and apparatus for coating road surfaces which significantly reduces capital equipment and labor costs as well as significantly reducing the paint drying time which results in a direct and significant reduction in the amount of congestion and inconvenience occurring over the period of the painting operation, which method and apparatus includes the use of pre- and post-heating steps which serve to significantly reduce drying time and to totally eliminate the traditional steps of placing and removing roadway detour devices which procedural steps are required when utilizing conventional painting methods.

The pre-heating step is performed by providing one or more heating units for generating radiant energy for performing the pre- and/or post-heating operations. The heating units are preferably of the type capable of generating radiant energy in the infrared and red wavelength bands. One or more such units are mounted upon a self-propelled vehicle or a vehicle such as a trailer capable of being pulled by a self-propelled vehicle. The heating units are preferably movably mounted upon the vehicle so as to be positioned or positionable in relatively close proximity to the road surface to be painted and so as to direct radiant energy toward at least the portion of the road surface to be heated. The radiant energy devices, in a preferred embodiment, are gas burning units, generating radiant energy in the infrared and red bands, which energy is capable of penetrating into the surface of the roadway so as to elevate the roadway surface to a temperature sufficient to significantly increase cross-linking of the paint ingredients, and hence the drying of the paint.

The radiant energy is derived from heating devices preferably comprising a ceramic fiber matrix supplied with a gas which is burned at the matrix surface, which heats and re-radiates energy in the infrared and red bands toward the road surface.

The heater units are preferably mounted upon a vehicle or trailer pulled by a vehicle, and are arranged in close proximity to the road surface during heating. The plurality of heating units may be mounted in a tandem array to increase the amount of heat according to local conditions. Separate arrays may be provided along opposite longitudinal sides of the vehicle to permit heating of a pair of parallel surfaces substantially simultaneously.

A microprocessor-based controller, which derives temperature readings of the road surface and/or ambient temperature, controls the heat energy directed to the road surface by controlling: spacing distance of the heating units from the road surface; proportionality of the gas mixture; flow rate of the gas mixture to the heating units and controlling the number of tandem units utilized for preheating; and vehicle speed.

The painting operation preferably immediately follows the preheating operation in order to obtain the greatest benefit from the heated road surface, which significantly enhances the cross-linking of the paint ingredients and drying of the paint. The painting apparatus is thus preferably mounted upon either the same vehicle or a trailer or other vehicle linked to the wheeled unit carrying the heating apparatus. The paint ingredients, typically a resin and a hardener, are mixed preparatory to being sprayed from a nozzle, and may also be heated during or just prior to mixing to further enhance drying of the paint.

Preheating of the road surface significantly enhances the drying rate of the paint.

Since the earth typically serves as a heat sink for drawing heat away from the heated road surface, a post-heating operation is utilized to prevent retardation of the drying operation due to the chilling effect of the road surface, which loses the heat applied thereto rather rapidly.

To assure the objective of rapid drying of the paint, a post-heating operation is performed utilizing substantially the same equipment utilized during preheating, which equipment preferably closely follows the paint applying apparatus by a short a distance as is practical. The post-heating apparatus may be part of the same vehicle supporting the preheating and painting apparatus or may be mounted upon a separate vehicle or trailer following the main vehicle and linked to and being towed by the vehicle supporting the preheating and painting apparatus. Alternatively, the heating units may be mounted upon a separate vehicle which closely follows the apparatus performing the spraying operation.

The post-heating apparatus is preferably of the same type as the preheating apparatus, and is controlled in a similar manner to increase the temperature level of the paint and supporting subsurface to a level similar to that obtained during the heating step.

The heating units may also be employed to remove unwanted paint.

OBJECTS OF THE INVENTION

It is therefore one object of the present invention to provide a novel method and apparatus for applying and drying paint on road surfaces and the like in an efficient and cost effective manner.

Still another object of the present invention is to provide novel method and apparatus for painting road surfaces and the like and which utilizes a pre-heating operation preparatory to painting.

Still another object of the present invention is to provide novel method and apparatus for painting road surfaces and the like utilizing a post-heating operation after painting to achieve a more efficient and cost effective painting operation.

Still another object of the present invention is to provide a novel method and apparatus for painting road surfaces and the like and which utilizes pre-heating and post-heating operations respectively before and after the painting operation to significantly enhance the cross-linking of the paint ingredients and drying of the paint and thereby yielding a more efficient, and cost effective technique which eliminates a significant amount of labor intensive activity required when utilizing conventional painting techniques.

Still another object of the present invention is to provide novel means for controlling pre- and/or post-heating apparatus for heating road surfaces and the like to an elevated temperature within a predetermined range thereby significantly enhancing the drying of a coating applied to the road surface.

Still another object of the present invention is to provide novel heating apparatus and control means therefore for removing unwanted paint and the like from road surfaces.

BRIEF DESCRIPTION OF THE FIGURES

The above as well as other objects of the present invention will become apparent when reading the accompanying description and drawings, in which.

DETAILED DESCRIPTION OF THE INVENTION AND PREFERRED EMBODIMENTS THEREOF

Figure 1:
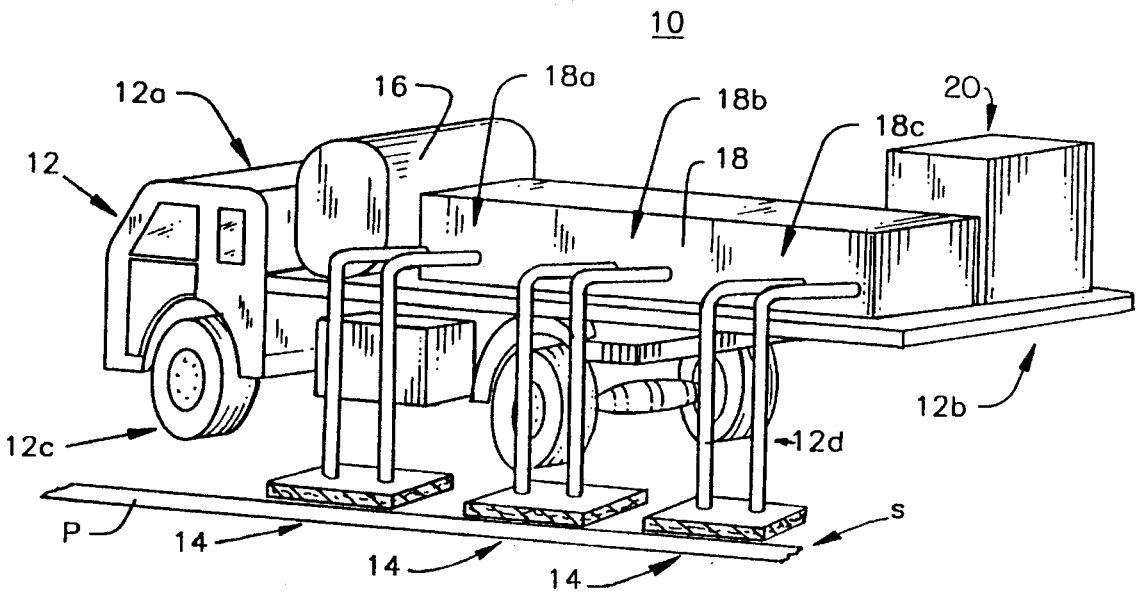
FIG. 1 is a simplified perspective view showing a vehicle mounting one or more of the types of apparatus employed to perform the novel method of the present invention.

FIG. 1 shows apparatus 10 employed for performing the method of the present invention and being comprised of a transport vehicle 12 which is preferably a truck or other suitable self-propelled vehicle comprised, for example, of a truck cab 12*a* and a truck bed 12*b* supported between the front 12*c* and rear wheels 12*d* and in turn supporting a plurality of gas fired infrared heater units 14.

Units 14 are supplied with a suitable combustible gas such as LPG or an equivalent thereto which is stored within holding tank 16.

An extension and retrieval mechanism 18 is mounted upon truck bed 12*b* and controls the lifting and lowering of pairs of telescoping support assemblies 18*a*, 18*b* and 18*c* each of which support a heating device and further incorporate a conduit (not shown) for supplying gas from tank 16 to the heater units.

Controls 20 are mounted at the rear of bed 12*b* and provide means for controlling the rate of gas flow, the gas mixture (such as a proportionality of air and gas in an air-gas mixture), the number of heater units operated and the spacing distance of the heater units from road surface S to be painted with a paint strip P.

Figure 1A:
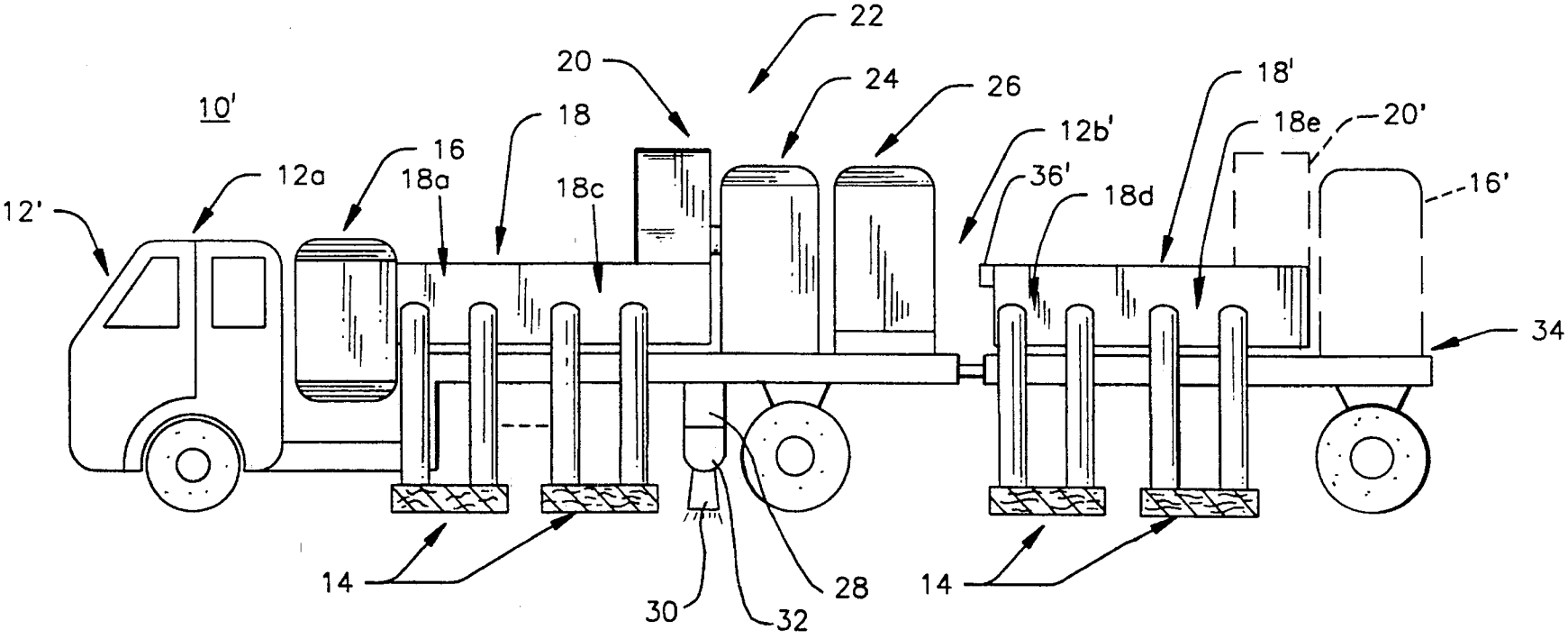
FIG. 1*a* is a simplified view of another embodiment of the present invention.

FIG. 1*a* shows a modified arrangement in which like elements are designated by like numerals and wherein an apparatus 10' is utilized to perform a painting operation which includes apparatus for pre-heating, painting and post-heating a road surface. The truck 12' in FIG. 1*a* differs from that of FIG. 1 in that the truck bed 12*b'* is elongated to accommodate painting apparatus 22 together with the preheating apparatus comprised of units 14, 16, 18 and 20.

The painting apparatus 22 is comprised of storage tanks 24 and 26 for storing the paint (or other coating) constituents, such as a resin and a binder, together with control means 28 for proportionally feeding the paint constituents to a spray head 30 and which includes means 32 for heating the constituents of the paint as they are admixed preparatory to being sprayed upon a road surface by spray head 30. The spraying equipment utilized in the present invention may be comprised of conventional spraying equipment such as, for example, a vehicle on which a driver observes the markers or previous stripe to position a spray head or on which an operator positions a movable boom carrying a spray head by observing a video image of a road surface.

The paint which is sprayed on the road surface may, for example, be two-part epoxy paints which exhibit improved weather resistance, UV stability and/or high reflectivity. Epoxy paints, while more expensive, are more commonly used on federal highways.

Alternatively, latex paints which contain reflective materials may also be used with the methods of the present invention.

It should be noted that spraying equipment and paint having characteristics similar to those set forth above may be substituted therefor. Also any other coatings, protective or otherwise, and which require a long drying period may be dried using the techniques disclosed herein.

A wheeled trailer or low-boy 34 may be coupled to vehicle 12' by suitable linkage assembly 36. Trailer 34 supports an extension and retrieval apparatus 18 substantially identical to that mounted on truck bed **12*b'* for supporting heating units 14 and for lifting and lowering units 14 through mechanisms 18*d* and 18*e* similar to the mechanisms 18*a* through 18*c* of FIG. 1. Although the embodiment of FIG. 1*a*** shows a reduced number of heating units provided, the actual number employed is dependent upon the particular application and may be a number which is greater or lesser than the number of units shown.

The post-heating apparatus on trailer 34 may be supplied with combustible gas (such as LPG) derived from the common tank 16 and be controlled by the controller 20 provided on truck bed **12*b'* or, alternatively, may be provided with its own supply tank 16' and controller 20', shown in dotted fashion and mounted upon trailer 34**.

Figure 2:
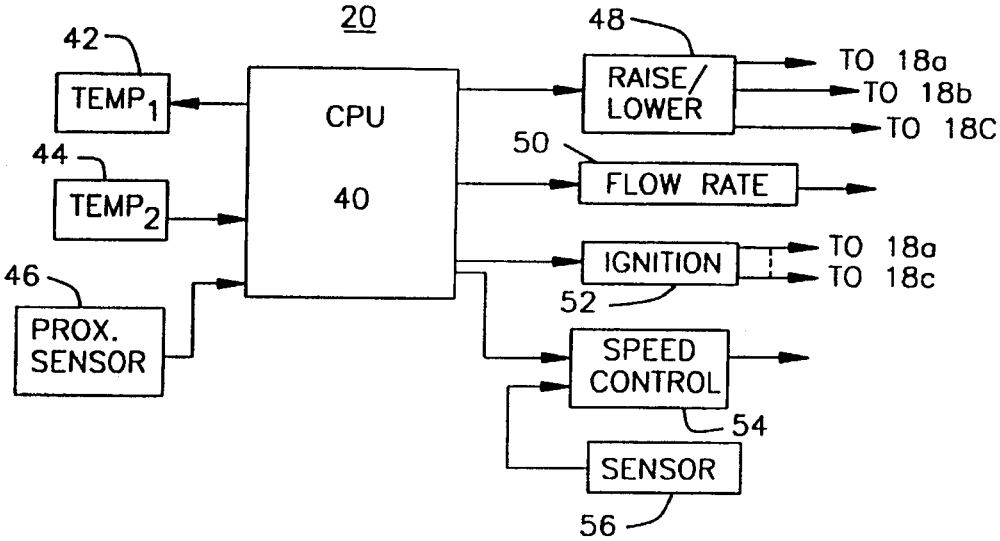
FIG. 2 is a simplified block diagram showing controller means for automatically controlling the apparatus of FIG. 1.

FIG. 2 shows the controller 20 in greater detail. The simplified block diagram of FIG. 2 shows controller 20 which is comprised of a central processing unit (CPU) which incorporates a microprocessor, a ROM for storing operating programs and a RAM of a capacity sufficient to accept input data and carry out controls and other functions in real time. The CPU senses road surface temperature by a first sensor 42 which may, for example, be an infrared sensor. The second temperature sensor 44 is utilized to sense ambient temperature which readings may be combined with sensor 42 to control the heating units 14.

A proximity sensor 46 measures the distance between the heating units 14 and the road surface. In instances where all of the heating units are simultaneously controlled to be moved to the same elevation above a road surface, it is necessary to provide only one proximity sensor per group of heating units for the pre- and post-heating apparatus. Alternatively, in applications where each heating unit is capable of being positioned relative to the road surface independently of one another, a proximity sensor may be provided for each heating unit.

The CPU 40 controls the various controllable means responsive to the sensed conditions. For example, given the road and ambient temperatures, CPU 40 controls the raising and lowering of each of the units **18*a* through 18*c* (or 18 through 18*e*) by means of control 48. The flow rate of the combustible gas is regulated by suitable valve means controlled by the flow rate controller 50, which valve means may form part of the spray assembly 30**. Pressure control means may be provided either as an alternative or in addition to the valve control means. The number of heater units operated during a heating operation can also be controlled in this manner.

Heater unit ignition is controlled by the ignition control circuit 52 which provides ignition of the desired heater units 14 and/or re-ignition in the event that there is a flame-out which may be detected by suitable flame-out sensor means, not shown for purposes of simplicity.

The temperature to which the road surface is elevated may further be controlled by controlling the dwell time of each heater unit per unit surface area of the road surface being heated. The dwell time may be controlled by controlling the speed of the vehicle through speed control 54. A speed sensor 56 senses the present speed of the vehicle which is compared in the speed control 54 with the desired speed to effect the appropriate adjustment in vehicle speed.

The heating units may be of any type conventionally available for providing radiant heat energy in the infrared and red wavelength bands. For example, the radiant heaters, in one preferred embodiment, are comprised of a gas fired radiant heater having a porous refractory panel through which a combustion mixture is passed. The combustion gas is ignited and burns at the surface of the panel which absorbs and/or reflects heat from the burning gas and reradiates the heat energy, especially in the infrared and red wavelength bands, toward a road surface. The porous panel can be flat, convex, concave or have any other desired configuration. Panels having a concave burning surface serve to focus and concentrate the heat energy. The panels can and preferably do have a width greater than the width of the strip or other pattern to be painted. The panels may be positioned so that there is a relatively small gap space G between adjacent edges, as shown in FIG. 1.

Although not shown for purposes of simplicity, heating units 14 may be placed on opposite longitudinal sides of the truck bed **12*b* enabling the heating of two "stripe-shaped" elongated regions of a road surface and, by providing spray units 30** on opposite longitudinal sides, two stripes may be painted substantially simultaneously immediately following the pre-heating operations.

The heating units described hereinabove may be of the type described in U.S. Pat. Nos. 3,785,763; 3,824,064; and 4,035,132, although any other type of radiant heater unit capable of generating radiant energy in the infrared and red wavelength bands may be utilized. For example, gas fired metallic and/or ceramic radiant heaters may be employed. Alternatively, electrically powered radiant heaters may be employed so long as they are capable of meeting the requirements of elevating the temperature of the road surface to a level which lies within a range that provides the significant improvement in the drying period described above.

To date, our experimentation has shown that elevating a road surface to temperatures of 150° F. or greater provide a significant reduction in the drying period, i.e. result in a quantum jump in reduced drying time as compared with standard drying period.

The heating units utilized are capable of providing infrared and red band radiation at temperatures in the range of from 950° to 1100° F. or more. Notwithstanding this temperature range, units of the type described are capable of being operated at temperatures of as much as 1500° or higher.

As was described hereinabove, the heating units 14 are arranged in tandem and are controlled to generate predetermined heat levels according to the road surface and/or ambient temperatures, further regulation being obtained by controlling the gas mixture (i.e. air/gas ratio) and spacing distance between the heating units and the road surface and the number of heating units ignited as well as controlling vehicle speed.

Vehicle operating speed normally employed when performing conventional painting operations is typically between 6 and 13 miles per hour and preferably between 6 and 9 miles per hour. Given the ambient weather and temperature conditions, lower speeds may be utilized, if desired.

Using conventional techniques, the "time window" available to paint road surfaces is rather narrow, painting operations typically being performed during the summer months and on clear, dry days when road surfaces are typically warmer than usual. Use of the techniques of the present invention significantly broadens the "time window" and, in addition, need not be confined to use on only dry, sunny days.

As was previously mentioned hereinabove, elevating the temperature of the admixed paint ingredients preparatory to spraying lowers the viscosity of the mixture, thus facilitating the spraying operation. The paint will nevertheless chill rapidly when applied to an unheated road surface thus significantly retarding the cross-linking and drying process. By raising the temperature level of the road surface during a preheating step to a temperature of 150° F. or greater significantly contributes to the drying process, reducing drying time to a small fraction of the time required when utilizing conventional techniques. Conventional air drying usually requires 20 to 30 minutes before vehicles are permitted to return to the roadway or those portions thereof which have been painted. The pre-heating operation, used alone, results in a 50% reduction in the drying period as compared with conventional drying, enabling vehicular traffic to use the treated road surface almost as soon as the equipment leaves the painted road surface.

It is preferred that the road surface not be heated to a temperature level which will cause discoloration and/or charring or burning of the paint. Using paints conventionally employed for painting road surfaces, the upper temperature is of the order of 165° F. However, the upper end of the temperature range may vary somewhat dependent upon the particular paint composition being utilized, the upper temperature range being determined in a straightforward manner.

The infrared band and red band radiation energy applied prior to the spraying operation and by the road surface is absorbed by the paint as it is deposited thereon. If desired, absorption of the energy by the paint can be enhanced by sprinkling granulated glass beads upon the freshly painted surface. The glass beads enhance the absorption of energy into the paint.

The post-heating step is utilized to ensure a final cure since cooling of the road surface and the paint starts as soon as the paint hits the road surface. Paints which are elevated in temperature just prior to spraying are typically elevated to a level of 140° F. This absorbed heat is dissipated quite rapidly in the absence of the pre-heating step.

The road surface is preferably elevated to the same temperature during the post-heating operation as is employed during the pre-heating operation. However, less heating energy typically is required during the post-heating operation since the road surface and paint retain some of the heat that has been absorbed due to the pre-heating step. The radian energy penetrates the paint and the road surface to enhance drying of the paint. Radiant energy in the region of 2.1 microns (which lies within the above mentioned wavelength bands) is employed to obtain the desired penetration of the radiant energy into the paint and road surface.

Use of both the pre- and post-heating operations respectively before and after spraying reduces the drying period to two (2) minutes or less thereby totally eliminating the need for setting up cones on the highway preparatory to the painting operation and, thereafter, the need for removing the highway cones 20 to 25 minutes after the spraying operation is completed. The elimination of these highly labor intensive operations significantly reduce painting costs in addition to significantly reducing the time interval during which vehicular traffic must depart from its normal flow rate and thus the amount of congestion caused thereby is likewise significantly reduced. The simplified process provides a more efficient use of man-hours and resources resulting in reduced operating costs.

The active heating system also allows a longer working season which ultimately leads to increased throughput per year resulting in increased gross revenue for equivalent capital equipment investment.

The apparatus utilized to paint continuous or broken lines, stripes or other patterns may utilize markers which are initially set up to identify the locations where the lines or patterns are to be formed, which markers may take the form of an asphalt or concrete seam in the case of new or resurfaced roads. In the case of re-striping applications, the paint coats the existing stripe or partially ground stripe.

In either case the driver of the truck steers the vehicle by watching a video monitor which displays the spray gun's target.

A boom operator may also "steer" the boom upon which the spray head is mounted onto the proper location. These techniques may also be applied to position the pre- and post-heating units which are detected by sensors to accurately position the spray heads at the desired locations.

The painting equipment and specifically the spray head (or heads) are mounted so as to be movable in a direction transverse to the direction of movement of the vehicle and sensors are provided to detect the markers and thereby spray paint onto the road surface at the desired locations, all of which techniques are conventional. The pre- and post-heating units may likewise be mounted on transversely movable supports and be positioned therealong by either the same equipment or equipment similar to that utilized for positioning the spray heads.

A further application for the heating units would be to aid in the removal of existing stripes. This is generally accomplished by over-curing the paint. This ultimately causes the existing stripe to lose adhesion with the road surface. The reduced adhesion permits a more efficient use of surface grinding to remove the paint chips.

This method also helps preserve the integrity of the road surface by reducing the mechanical contact of the grinder with the road surface.

Typically, surface temperatures in excess of 200° F. with two (2) minute dwell times are required to sufficiently affect (i.e. degrade) the adhesion properties.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed:

1. A method of coating a road surface with a paint employing a ceramic radiation panel mounted upon a wheeled carriage so as to be positioned above the road surface comprising the steps of:

(a) moving the wheeled carriage along the road surface;

(b) heating the ceramic panel to generate radiant energy and directing radiant energy within the infrared and red wavelength band toward a portion of a road surface to be coated to elevate the temperature thereof;

(c) spraying a coating of paint upon the preheated surface which is elevated to a temperature to promote significantly rapid drying of the paint; and (d) heating a second ceramic panel to generate radiant energy and heating the coated surface by directing radiant energy in the infrared and red band to heat the road surface and the paint coated thereon.

2. The method of claim 1 wherein the step of heating the road surface further comprises heating the road surface to a temperature in the range of between 150° F. and 165° F.

3. The method of claim 2 wherein the step of controlling the temperature of the portion of the road surface to be heated further comprises regulating a speed at which the vehicle moves over the road surface.

4. The method of claim 1 wherein the steps of heating the road surface further comprises heating the road surface to a temperature in a given range, a lower end of said range being 150° F. and an upper end of the range being a temperature that is less than a temperature which would cause the coating of paint to discolor and/or char.

5. The method of claim 1 wherein the step of generating radiant energy further comprises the steps of:

providing a heating unit comprising a porous matrix and;

feeding a combustible gas to the heating unit and igniting the gas to cause it to burn at a surface of the matrix facing the road surface to be heated;

detecting a temperature of a portion of the road surface to be heated and controlling at least one of the spacing of the heating unit from the portion of the road surface to be heated, or the constituents of the combustible gas mixture; and regulating the flow rate of the gas mixture to the matrix to control the temperature of the radiant energy directed to the portion of the road surface to be heated.

6. A method for removing unwanted paint from a road surface including the steps of:

(a) providing a ceramic radiant energy source;

(b) heating the radiant energy source to generate radiant energy in the infrared and red wave length bands and directing said energy upon at least those portions of the surface coated with the unwanted paint;

the step of generating the radiant energy further comprising the steps of generating radiant energy at a level sufficient to cause the unwanted paint coating to be burned away by heating the road surface to a temperature of at least 165° F.

7. Apparatus for pre-heating a road surface comprising:

a wheeled vehicle;

at least one heating unit mounted upon said wheeled vehicle;

said heating unit being a ceramic radiator panel having radiant energy emitting surface;

means provided on said vehicle for adjusting a spacing the emitting surface relative to said road surface;

an energy source mounted on said vehicle for supplying energy to said heating unit to enable said heating unit to generate radiant energy in infrared and red wavelength bands, which radiant energy is directed toward said road surface;

means mounted on said vehicle for detecting road surface temperature; and means responsive to a detected road surface temperature for adjusting a position of the emitter surface relative to said road surface to control an amount of energy radiated to said road surface and thereby regulate an increase in temperature level of road surface, said energy source comprising a combustible gas;

means for regulating a rate of flow of gas to said heating unit emitter surface to adjust the level of radiant energy directed to said road surface; and a unit for spraying a paint upon the road surface;

said heating unit including means for directing the paint toward those portions of the road surface heated by said heating unit.

8. The apparatus of claim 7 wherein said mixture comprises an air/gas mixture and said regulating means comprises means for regulating the portionality of the air and the gas in said air/gas mixture.

9. Apparatus for pre-heating a road surface comprising:

a wheeled vehicle;

a plurality of heating units mounted upon said wheeled vehicle;

each of said heating units being a ceramic panel having a radiant energy emitting surface;

means provided on said vehicle for adjusting a spacing of each of the emitting surfaces relative to said road surface;

means mounted on said vehicle for supplying energy to said heating units to enable said heating units to generate radiant energy in infrared and red wavelength bands, which radiant energy is directed toward said road surface;

means mounted on said vehicle for detecting road surface temperature;

means responsive to a detected road surface temperature for adjusting positions of the emitter surfaces relative to said road surface to control an amount of energy radiated to said road surface and thereby regulate an increase in temperature level of the road surface beneath said emitter surfaces; and a unit for spraying a paint upon the road surface;

said unit including means for directing the paint toward those portion of the road surface by said heating unit.

10. The apparatus of claim 9 further including means for regulating the flow of energy from said energy source to each of said units to regulate radiant energy emitted toward the road surface.

11. The apparatus of claim 9 further comprising means to control a number of heating units to be coupled to said energy source to regulate an amount of energy radiated to the road surface.

12. In combination:

a wheeled vehicle;

apparatus mounted on said wheeled vehicle for spraying a coating on a portion of a road surface;

at least one ceramic heating unit mounted upon said wheeled vehicle at a location rearward of said coating apparatus;

said heating unit having a radiant energy emitting surface;

means provided on said vehicle for adjusting a spacing of the emitting surface relative to said road surface;

a combustible fuel energy source mounted on said vehicle for supplying energy to said heating unit, enabling said heating unit to generate radiant energy in infrared and red wavelength bands, which radiant energy is directed toward at least that portion of the road surface receiving said coating;

means for controlling said heating unit to heat said road surface and said coating to a temperature in a range which causes said coating to dry rapidly; and means mounted on said vehicle for detecting road surface temperature, said means for controlling the energy emitted from said emitting surface comprising means responsive to said detected temperature to control a level of radiant energy emitted from said emitting surface.

13. In combination:

a first wheeled vehicle;

apparatus mounted on said wheeled vehicle for spraying a paint on a portion of a road surface;

at least one heating unit mounted upon a second wheeled vehicle arranged at a location rearward of said spraying apparatus;

at least one of said heating units having a ceramic panel with a radiant energy emitting surface for generating radiant energy in an infrared and a red wavelength band to heat said paint and the road surface therebeneath;

means provided on said second vehicle for adjusting a spacing of the emitting surface relative to said road surface;

a combustible fuel energy source mounted said second vehicle for supplying energy to said heating unit, enabling said heating unit to generate radiant energy in infrared and red wavelength bands, which radiant energy is directed toward at least that portion of the road surface receiving said paint;

means for controlling said heating unit to heat said road surface and said paint to a temperature in a range which causes said paint to dry rapidly;

means mounted on said vehicle for detecting road surface temperature, said means for controlling the radiant energy emitted from said emitting surface comprising means responsive to said detected temperature to control a level of radiant energy emitted from said emitting surface;

a second heating unit arranged rearwardly of said spraying apparatus for heating the paint and road surface therebeneath to rapidly dry said coating.

* * * * *